US011317725B2

(12) United States Patent
Shi

(10) Patent No.: US 11,317,725 B2
(45) Date of Patent: May 3, 2022

(54) OUTDOOR SLEEPING MAT AND SLEEPING MAT SET

(71) Applicant: Dongguan Hongyu Plastic Rubber Co., Ltd., Dongguan (CN)

(72) Inventor: Juying Shi, Nanchong (CN)

(73) Assignee: DONGGUAN HONGYU PLASTIC RUBBER CO., LTD., Dongguan (CN)

( * ) Notice: Subject to any disclaimer, the term of this patent is extended or adjusted under 35 U.S.C. 154(b) by 0 days.

(21) Appl. No.: 16/992,924

(22) Filed: Aug. 13, 2020

(65) Prior Publication Data

US 2022/0047085 A1 Feb. 17, 2022

(51) Int. Cl.

| | |
|---|---|
| ***A47C 27/18*** | (2006.01) |
| ***A47C 17/64*** | (2006.01) |
| ***A47C 27/08*** | (2006.01) |
| ***A47C 27/16*** | (2006.01) |

(52) U.S. Cl.

CPC ..... *A47C 17/64* (2013.01); *A47C 27/081* (2013.01); *A47C 27/16* (2013.01); *A47C 27/18* (2013.01)

(58) Field of Classification Search

CPC ..... A47C 17/64; A47C 27/08; A47C 27/081; A47C 27/16; A47C 27/18

See application file for complete search history.

(56) References Cited

U.S. PATENT DOCUMENTS

| | | | | |
|---|---|---|---|---|
| 802,526 | A * | 10/1905 | Russell | A47C 27/087 5/711 |
| 3,283,343 | A * | 11/1966 | Worcester | A47C 27/081 5/644 |
| 6,131,219 | A * | 10/2000 | Roberts | A47G 9/1027 5/636 |
| 6,799,339 | B2 * | 10/2004 | Stewart | A47C 27/081 5/413 AM |
| 2013/0019409 | A1 * | 1/2013 | Blazar | A47G 9/1027 5/644 |

* cited by examiner

*Primary Examiner* — Fredrick C Conley
(74) *Attorney, Agent, or Firm* — Bayramoglu Law Offices LLC

(57) ABSTRACT

An outdoor sleeping mat and a sleeping mat set includes a sleeping mat main body, a plurality of transverse supporting belts and a plurality of vertical supporting belts. The sleeping mat main body has a cavity, and the transverse supporting belts and the vertical supporting belts are disposed in the cavity and connected to the sleeping mat main body. The plurality of vertical supporting belts are distributed at two sides of the sleeping mat main body in a width direction, and the plurality of transverse supporting belts are arranged side by side in a length direction of the sleeping mat main body. The outdoor sleeping mat enhances the structural reliability of the sleeping mat main body through the plurality of transverse supporting belts and the plurality of vertical supporting belts, so that the whole outdoor sleeping mat has better supporting performance.

10 Claims, 3 Drawing Sheets

OUTDOOR SLEEPING MAT AND SLEEPING MAT SET

TECHNICAL FIELD

The present application relates to the technical field of outdoor products, and in particular, to an outdoor sleeping mat and a sleeping mat set.

BACKGROUND

Some ordinary outdoor inflatable mats have interconnected integral air bags inside, and some internally have two-body air bags which are separated from each other and inflated respectively. When people sit or lie on such an inflatable mat, stressed parts are squashed. The inflatable mat is shaken and deformed when people sit or lie on the inflatable mat, change their body positions and turn over. As a result, different people sitting or lying on the inflatable mat affect each other, and easily affect each other's rest. In addition, because its shape varies with the human body position, supporting points also change accordingly at any time. Many users believe that sitting and lying on the mat make them tired, which is not conducive to improving their rest quality.

SUMMARY

An objective of the present application is to provide an outdoor sleeping mat, which can solve the problem that an existing outdoor inflatable mat is not comfortable enough when used and affects the rest quality.

Another objective of the present application is to provide a sleeping mat set, which includes the outdoor sleeping mat and has all characteristics of the outdoor sleeping mat.

An embodiment of the present application is implemented as follows:

The embodiment of the present application provides an outdoor sleeping mat, which includes a sleeping mat main body, a plurality of transverse supporting belts and a plurality of vertical supporting belts;

the sleeping mat main body has a cavity, and the transverse supporting belts and the vertical supporting belts are disposed in the cavity and connected to the sleeping mat main body;

the plurality of vertical supporting belts are distributed at two sides of the sleeping mat main body in a width direction, and the plurality of transverse supporting belts are arranged side by side in a length direction of the sleeping mat main body.

The sleeping mat main body is supported by the plurality of transverse supporting belts and the plurality of vertical supporting belts, so that the sleeping mat main body can have better supporting performance. This reduces the deformation in the use process, and enables the user to have a more comfortable lying experience.

In addition, the outdoor sleeping mat according to the embodiment of the present application can also have the following additional technical characteristics.

In an optional embodiment of the present application, the sleeping mat main body is defined by an upper piece, a lower piece and a side surrounding piece, the transverse supporting belts are connected between the upper piece and the lower piece, and the vertical supporting belts are connected between the upper piece and the lower piece.

In an optional embodiment of the present application, the outdoor sleeping mat includes a boundary supporting belt, the boundary supporting belt is arranged in the sleeping mat main body and divides the sleeping mat main body into a pillow portion and a lying portion, and a height of the pillow portion is greater than that of the lying portion after the sleeping mat main body is inflated.

As the pillow portion is designed, the head of the user can be better supported when he/she lies, so that the comfort is better when the user lies.

In an optional embodiment of the present application, a middle portion of the pillow portion in a width direction is recessed relative to both sides of the pillow portion, and the transverse supporting belts are distributed at the recessed positions.

The recessed positions enable the head to be better wrapped. In addition, the structure is strengthened by the transverse supporting belts. Therefore, when the user lies, better comfort can be achieved while the head is better supported. This avoids a stiff neck caused after an ordinary inflatable mat is used.

In an optional embodiment of the present application, the outdoor sleeping mat includes an inflatable structure which includes a resilient member, a unidirectional air inlet nozzle and a sealing structure, the inflatable structure is arranged at a position of an air hole of the sleeping mat main body, the resilient member is located in the cavity, the unidirectional air inlet nozzle is arranged in the air hole, and the sealing structure is detachably connected with the unidirectional air inlet nozzle; and after the sealing structure releases the sealing of the unidirectional air inlet nozzle, the resilient member is pressed, so that gas outside the cavity enters the cavity through the unidirectional air inlet nozzle.

The inflatable structure is arranged on the sleeping mat main body. When the outdoor sleeping mat is used, external air can enter the sleeping mat main body through the air hole without an external inflating tool only by stepping on the resilient member or pressing the resilient member with the arm. This solves the unexpected situation that the common outdoor inflatable mat cannot be used outdoors because the user misses an inflating tool.

In an optional embodiment of the present application, an inflatable mat table is arranged in the sleeping mat main body and supported below the resilient member.

The inflatable mat table can support the resilient member during inflation. This avoids the damage to the sleeping mat main body caused by the contact between the resilient member and the ground below the outdoor sleeping mat when the inflation amount is still small, thereby preventing air leakage.

In an optional embodiment of the present application, the resilient member is a sponge resilient block, the center of the sponge resilient block is provided with a through hole, and the unidirectional air inlet nozzle is located in the through hole;

when the sponge resilient block is deformed, the through hole and the air hole are blocked by the unidirectional air inlet nozzle; and when the sponge resilient block recovers from the deformation, the unidirectional air inlet nozzle is unblocked, so that the through hole is communicated with the air hole.

In an optional embodiment of the present application, the outdoor sleeping mat includes a pull-out air nozzle, and the pull-out air nozzle is arranged in the sleeping mat main body.

The pull-out air nozzle can be pulled out integrally. When the deflation is required, the width of an exhaust channel can be increased by integrally pulling out the pull-out air nozzle, thus accelerating the exhaust speed.

In an optional embodiment of the present application, the pull-out air nozzle is arranged at the bottom of the sleeping mat main body. Since the pull-out air nozzle is arranged at the bottom of the sleeping mat main body, when the user lies normally, the pull-out air nozzle can be prevented from accidentally dropping out. This improves the reliability of the outdoor sleeping mat in use.

An embodiment of the present application provides a sleeping mat set, which includes an accommodating bag and any of the outdoor sleeping mats, where the outdoor sleeping mat can be placed in the accommodating bag after the cavity of the outdoor sleeping mat is deflated.

The outdoor sleeping mat is convenient to carry outdoors by providing the matched accommodating bag for the outdoor sleeping mat, and the outdoor sleeping mat does not need to be placed in a device like as a backpack, so that such a device like the backpack can contain other products, making the outdoor travel more convenient.

BRIEF DESCRIPTION OF THE DRAWINGS

To describe the technical solutions in the embodiments of the present application more clearly, the following briefly describes the accompanying drawings required for describing the embodiments. It should be understood that, the following accompanying drawings show merely some embodiments of the present application, and therefore should not be regarded as a limitation on the scope. A person of ordinary skill in the art may still derive other related accompanying drawings from these accompanying drawings without creative efforts.

Figure 1:
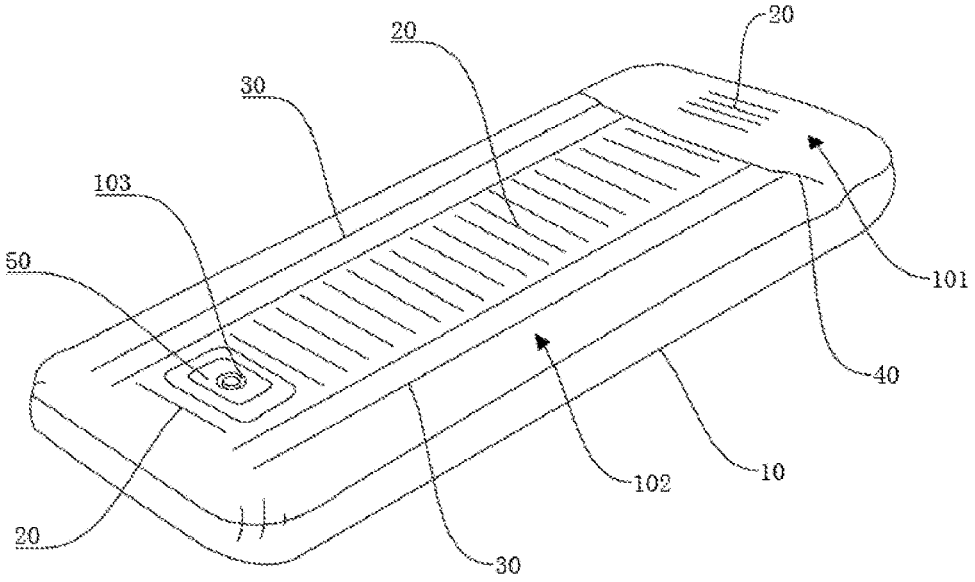
FIG. 1 is a schematic view of an outdoor sleeping mat according to Embodiment 1 of the present application.

Reference numerals: 10. sleeping mat main body, 11. upper piece, 12. lower piece, 101. pillow portion, 102. lying portion, 103. air hole, 20. transverse supporting belt, 30. vertical supporting belt, 40. boundary supporting belt, 50. inflatable structure, 51. resilient member, 511. through hole, 52. unidirectional air inlet nozzle, 53. sealing structure, 531. sealing cover, 532. knob cover, 54. inflatable mat table, 60. pull-out air nozzle.

DESCRIPTION OF THE EMBODIMENTS

In order to make the objectives, technical solutions and advantages of the embodiments of the present application clearer, the following clearly and completely describes the technical solutions in the embodiments of the present application with reference to accompanying drawings in the embodiments of the present application. Apparently, the described embodiments are some rather than all of the embodiments. Components of the embodiments of the present application generally described and illustrated in the accompanying drawings may be arranged and designed in various different configurations.

Therefore, the following detailed description of the embodiments of the present application provided in the accompanying drawings is not intended to limit the scope of the claimed present application, but merely represents selected embodiments of the present application. All other embodiments obtained by a person of ordinary skill in the art based on the embodiments of the present application without creative efforts shall fall within the protection scope of the present application.

It should be noted that similar reference signs and letters represent similar items in the accompanying drawings below. Therefore, once an item is defined in one accompanying drawing, it does not need to be further defined and described in subsequent accompanying drawings.

In the description of the present application, it should be noted that orientation or position relationships indicated by terms "inner", "outer", etc. are orientation or position relationships shown in the accompanying drawings, or the usual orientation or position relationships of the products when in use. These terms are only used to facilitate description of the present application and simplify the description, but not to indicate or imply that the mentioned apparatus or components must have a specific orientation or must be established and operated in a specific orientation, and thus these terms cannot be understood as a limitation to the present application. In addition, the terms such as "first" and "second" are used only for distinguishing descriptions and cannot be understood to indicate or imply relative importance.

In the description of the present application, it should be noted that, unless otherwise clearly specified and limited, meanings of terms "arrange" and "connect" should be understood in a board sense. For example, the connection may be a fixed connection, a detachable connection, or an integral connection; may be a mechanical connection or an electrical connection; may be a direct connection or an indirect connection by using an intermediate medium; or may be intercommunication between two components. A person of ordinary skill in the art may understand specific meanings of the foregoing terms in the present application based on a specific situation.

Embodiment

Referring to FIGS. 1 to 4, Embodiment 1 of the present application provides an outdoor sleeping mat, which includes a sleeping mat main body 10, a plurality of transverse supporting belts 20 and a plurality of vertical supporting belts 30;

the sleeping mat main body 10 has a cavity, and the transverse supporting belts 20 and the vertical supporting belts 30 are disposed in the cavity and connected to the sleeping mat main body 10;

the plurality of vertical supporting belts 30 are distributed at two sides of the sleeping mat main body 10 in a width direction, and the plurality of transverse supporting belts 20 are arranged side by side in a length direction of the sleeping mat main body 10.

The sleeping mat main body 10 is supported by the plurality of transverse supporting belts 20 and the plurality of vertical supporting belts 30, so that the sleeping mat main body 10 can have better supporting performance. This reduces the deformation in the use process, and enables the user to have a more comfortable lying experience. Further, the outdoor sleeping mat according to the present application is made of an environment-friendly polymer TPU material adhering to a nylon fabric. Compared with a conventional sleeping mat, the outdoor sleeping mat has the advantages of higher wear resistance, environmental friendliness, no toxicity, etc. The service life of the product used for a long time and the health of consumers are effectively guaranteed.

In addition, because of the good supporting effect, the user can be effectively separated from a supporting surface when lying, and the outdoor sleeping mat can prevent moisture and preserve heat during camping. Besides, since no large deformation occurs to a single position of the outdoor sleeping mat, the outdoor sleeping mat does not fall like an ordinary outdoor mat. Moreover, when the user gets up from or lies on the mat, the contact between the human body and the supporting surface through the sleeping mat main body 10 caused by the higher pressure at a single position does not occur, thus causing no discomfort or pain. In addition, when many people use the outdoor sleeping mat, the good supporting effect brought by a plurality of transverse supporting belts 20 and a plurality of vertical supporting belts 30 can also prevent the users from affecting each other. For example, the outdoor sleeping mat avoids the situation that when a person turns over or gets up from or lies on the ordinary outdoor mat, the sleeping mat main body 10 is greatly deformed, which affects others who are lying. Therefore, the outdoor sleeping mat facilitates the user's rest.

Figure 2:
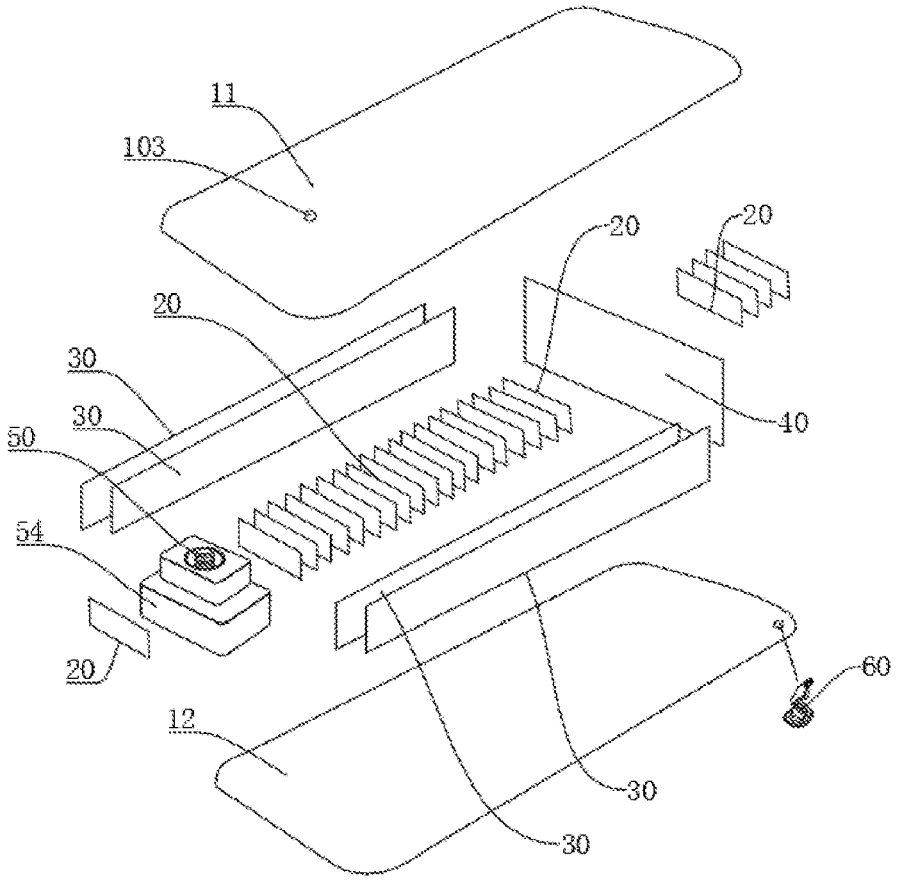
FIG. 2 is a schematic view of an internal structure of FIG. 1.

Specifically, referring to FIG. 2, the sleeping mat main body 10 of this embodiment is defined by an upper piece 11, a lower piece 12 and a side surrounding piece, the transverse supporting belts 20 are connected between the upper piece 11 and the lower piece 12, and the vertical supporting belts 30 are connected between the upper piece 11 and the lower piece 12. The side surrounding piece may be a separate annular blocking piece, or may be formed by connection after extending edges of the upper piece 11 and the lower piece 12. The side surrounding piece is not directly shown in FIG. 2, but it does not hinder the understanding by those skilled in the art.

Specifically, the outdoor sleeping mat includes a boundary supporting belt 40, the boundary supporting belt 40 is arranged in the sleeping mat main body 10 and divides the sleeping mat main body 10 into a pillow portion 101 and a lying portion 102, and a height of the pillow portion 101 is greater than that of the lying portion 102 after the sleeping mat main body 10 is inflated. As the pillow portion 101 is designed, the head of the user can be better supported when he/she lies, so that the comfort is better when the user lies.

In detail, a middle portion of the pillow portion 101 in a width direction is recessed relative to both sides of the pillow portion, and the transverse supporting belts 20 are distributed at the recessed positions.

The recessed positions enable the head to be better wrapped. In addition, the structure is strengthened by the transverse supporting belts 20. Therefore, when the user lies, better comfort can be achieved while the head is better supported. This avoids a stiff neck caused after an ordinary inflatable mat is used.

Figure 3:
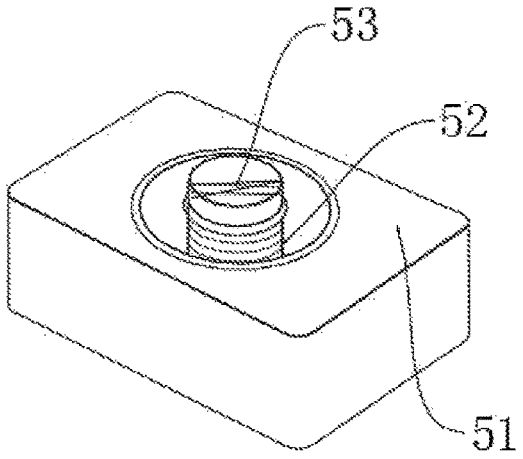
FIG. 3 is a schematic view of an inflatable structure in FIG. 2.
Figure 4:
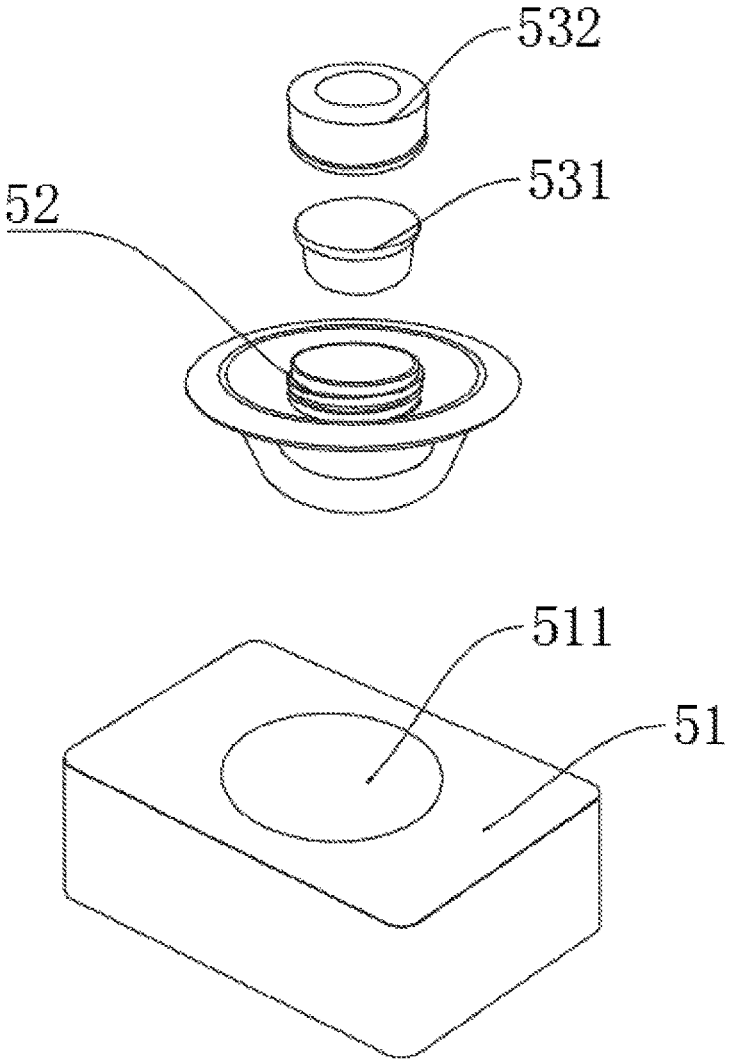
FIG. 4 is an exploded view of FIG. 3.

Referring to FIGS. 3 and 4, the outdoor sleeping mat of this application includes an inflatable structure 50 which includes a resilient member 51, a unidirectional air inlet nozzle 52 and a sealing structure 53, the inflatable structure 50 is arranged at a position of an air hole 103 of the sleeping mat main body 10, the resilient member 51 is located in the cavity, the unidirectional air inlet nozzle 52 is arranged in the air hole 103, and the sealing structure 53 is detachably connected with the unidirectional air inlet nozzle 52.

After the sealing structure 53 releases the sealing of the unidirectional air inlet nozzle 52, the resilient member 51 is pressed, so that gas outside the cavity enters the cavity through the unidirectional air inlet nozzle 52. In this embodiment, the adopted sealing structure 53 includes a sealing cover 531 and a knob cover 532. The sealing cover 531 can block an air inlet of the air inlet nozzle. An outer wall of the air inlet nozzle is provided with a thread, and the sealing cover 531 is in thread fit with the air inlet nozzle through the knob cover 532, so that a fixing function is added on the basis of the sealing cover 531, and thus the sealing cover 531 is not separated from the air inlet. When inflation is required, it is implemented by dismantling the sealing cover 531 and the knob cover 532. After the inflation, the sealing cover 531 and the knob cover 532 are sequentially assembled to the air inlet nozzle. As the air inlet nozzle features unidirectional air admission, gas in the sleeping mat main body 10 cannot escape from the air hole 103 during inflation and use.

The inflatable structure 50 is arranged on the sleeping mat main body 10. When the outdoor sleeping mat is used, external air can enter the sleeping mat main body 10 through the air hole 103 without an external inflating tool only by stepping on the resilient member 51 or pressing the resilient member 51 with the arm. This solves the unexpected situation that the common outdoor inflatable mat cannot be used outdoors because the user misses an inflating tool.

Further, an inflatable mat table 54 is arranged in the sleeping mat main body 10 and supported below the resilient member 51. The inflatable mat table 54 can support the resilient member 51 during inflation. This avoids the damage to the sleeping mat main body 10 caused by the contact between the resilient member 51 and the ground below the outdoor sleeping mat when the inflation amount is still small, thereby preventing air leakage.

Since the inflatable mat table 54 has a larger contact area with the lower piece 12, when the resilient member 51 is pressed, the pressing force can be dispersed to the lower piece 12. This avoids the damage caused by pressing due to a smaller stress surface of the lower piece 12 when there are sundries on the lower supporting surface of the lower piece 12.

In this embodiment, the resilient member 51 is a sponge resilient block, the center of the sponge resilient block is provided with a through hole 511, and the unidirectional air inlet nozzle 52 is located in the through hole 511.

In detail, when the sponge resilient block is deformed, the through hole 511 and the air hole 103 are blocked by the unidirectional air inlet nozzle 52; and when the sponge resilient block recovers from the deformation, the unidirectional air inlet nozzle 52 is unblocked, so that the through hole 511 is communicated with the air hole 103. Since there are many pores in the sponge, during the resilient process, the air hole 103 can suck air, and gas can pass through the pores of the sponge and enter the cavity of the sleeping mat main body 10.

Specifically, the outdoor sleeping mat includes a pull-out air nozzle 60, and the pull-out air nozzle 60 is arranged in the sleeping mat main body 10. The pull-out air nozzle 60 can be pulled out integrally. When the deflation is required, the width of an exhaust channel can be increased by integrally pulling out the pull-out air nozzle, thus accelerating the exhaust speed.

More specifically, the pull-out air nozzle 60 in this embodiment is arranged at the bottom of the sleeping mat main body 10. Since the pull-out air nozzle 60 is arranged at the bottom of the sleeping mat main body 10, when the user lies normally, the pull-out air nozzle 60 can be prevented from accidentally dropping out. This improves the reliability of the outdoor sleeping mat in use.

Based on the outdoor sleeping mat, an embodiment of the present application provides a sleeping mat set, which includes an accommodating bag and the outdoor sleeping mat, where the outdoor sleeping mat can be placed in the accommodating bag after the cavity of the outdoor sleeping mat is deflated. The outdoor sleeping mat is convenient to carry outdoors by providing the matched accommodating bag for the outdoor sleeping mat, and the outdoor sleeping mat does not need to be placed in a device like as a backpack, so that such a device like the backpack can contain other products, making the outdoor travel more convenient.

In summary, the outdoor sleeping mat according to the present application enhances the structural reliability of the sleeping mat main body 10 through the plurality of transverse supporting belts 20 and the plurality of vertical supporting belts 30, so that the whole outdoor sleeping mat has better supporting performance. The outdoor sleeping mat has the advantages of moisture resistance, heat preservation, falling prevention, etc., and solves the problems of discomfort and pain caused by direct contact between the human body and the ground through a product when a user lies on or gets up from a conventional sleeping mat. Through an accommodating bag, the outdoor sleeping mat is more convenient to carry outdoors and use.

Figure 5:
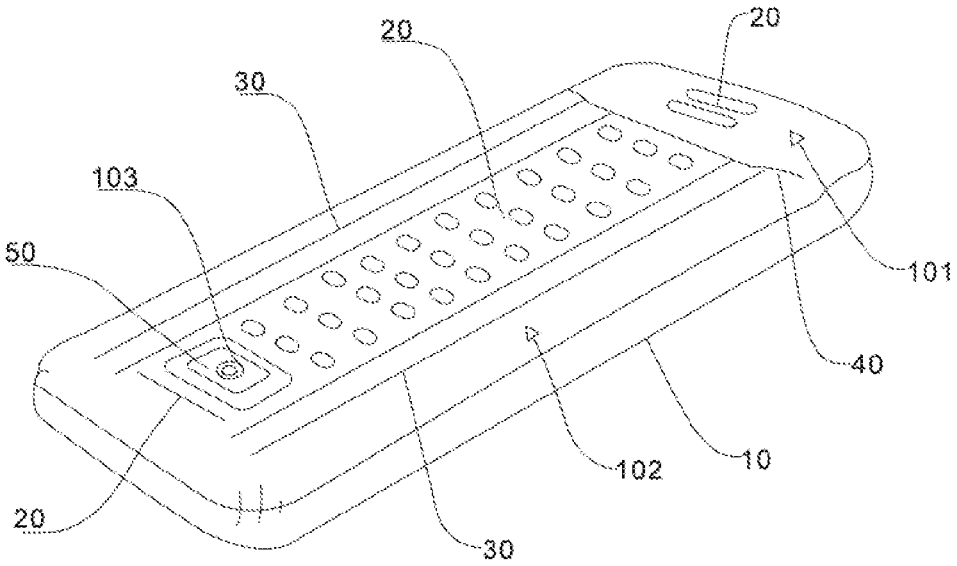
FIG. 5 is a schematic view of an outdoor sleeping mat according to Embodiment 2 of the present application.
Figure 6:
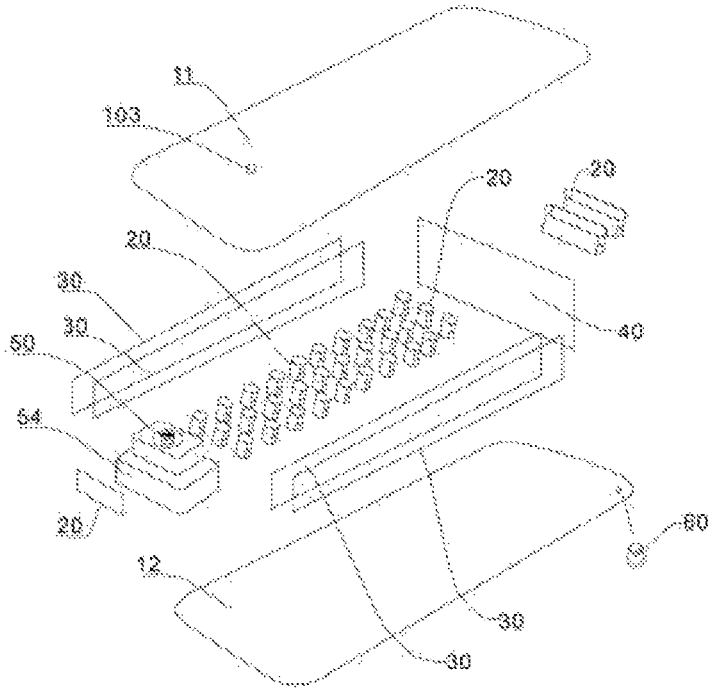
FIG. 6 is a schematic view of an internal structure of FIG. 5.

Referring to FIGS. 5 to 6, Embodiment 2 of the present application provides an outdoor sleeping mat, which includes a sleeping mat main body 10, a plurality of transverse supporting belts 20 and a plurality of vertical supporting belts 30; the sleeping mat main body 10 has a cavity, and the transverse supporting belts 20 and the vertical supporting belts 30 are disposed in the cavity and connected to the sleeping mat main body 10; the plurality of vertical supporting belts 30 are distributed at two sides of the sleeping mat main body 10 in a width direction, and the plurality of transverse supporting belts 20 are arranged side by side in a length direction of the sleeping mat main body 10. The sleeping mat main body 10 is supported by the plurality of transverse supporting belts 20 and the plurality of vertical supporting belts 30, so that the sleeping mat main body 10 can have better supporting performance. This reduces the deformation in the use process, and enables the user to have a more comfortable lying experience. This embodiment differs from Embodiment 1 in that the transverse supporting belts 20 each have a columnar structure, i.e., the cross section is circular or elliptical. This provides the massage effect and disperses the stress, so that the sleeping mat main body is supported more stably. Certainly, the cross section of the transverse supporting belt 20 is not limited to the circular or elliptical shape. For those in the art, various modifications and variations can be made to the cross section, e.g., the cross section may be a square shape.

The above is merely preferred embodiments of the present application and is not intended to limit the present application, and various changes and modifications can be made to the present application by those skilled in the art. Any modification, equivalent replacements, improvement, and the like made within the spirit and principle of the present application should fall within the protection scope of the present application.

What is claimed is:

1. An outdoor sleeping mat, comprising a sleeping mat main body, a plurality of transverse supporting belts and a plurality of vertical supporting belts;

the sleeping mat main body has a cavity, and the transverse supporting belts and the vertical supporting belts are disposed in the cavity and connected to the sleeping mat main body;

the plurality of vertical supporting belts are distributed peripherally at two sides of the sleeping mat main body in a width direction, and the plurality of transverse supporting belts are arranged side by side in a length direction of the sleeping mat main body;

wherein the transverse supporting belts are located inside the sleeping mat main body; and wherein the transverse supporting belts and the vertical supporting belts do not intersect such that the sleeping mat main body is better supported without any mutual influence from the transverse supporting belts and the vertical supporting belts during use.

2. The outdoor sleeping mat according to claim 1, wherein the sleeping mat main body is defined by an upper piece, a lower piece and a side surrounding piece, the transverse supporting belts are connected between the upper piece and the lower piece, and the vertical supporting belts are connected between the upper piece and the lower piece.

3. The outdoor sleeping mat according to claim 1, wherein the outdoor sleeping mat comprises a boundary supporting belt, the boundary supporting belt is arranged in the sleeping mat main body and divides the sleeping mat main body into a pillow portion and a lying portion, and a height of the pillow portion is greater than that of the lying portion after the sleeping mat main body is inflated.

4. The outdoor sleeping mat according to claim 3, wherein a middle portion of the pillow portion in a width direction is recessed relative to both sides of the pillow portion, and the transverse supporting belts are distributed at the recessed positions.

5. The outdoor sleeping mat according to claim 1, wherein the outdoor sleeping mat comprises an inflatable structure which comprises a resilient member, a unidirectional air inlet nozzle and a sealing structure, the inflatable structure is arranged at a position of an air hole of the sleeping mat main body, the resilient member is located in the cavity, the unidirectional air inlet nozzle is arranged in the air hole, and the sealing structure is detachably connected with the unidirectional air inlet nozzle; and after the sealing structure releases the sealing of the unidirectional air inlet nozzle, the resilient member is pressed, so that gas outside the cavity enters the cavity through the unidirectional air inlet nozzle.

6. The outdoor sleeping mat according to claim 5, wherein an inflatable mat table is arranged in the sleeping mat main body and supported below the resilient member.

7. The outdoor sleeping mat according to claim 5, wherein the resilient member is a sponge resilient block, the center of the sponge resilient block is provided with a through hole, and the unidirectional air inlet nozzle is located in the through hole;

when the sponge resilient block is deformed, the through hole and the air hole are blocked by the unidirectional air inlet nozzle; and when the sponge resilient block recovers from the deformation, the unidirectional air inlet nozzle is unblocked, so that the through hole is communicated with the air hole.

8. The outdoor sleeping mat according to claim 1, wherein the outdoor sleeping mat comprises a pull-out air nozzle and the pull-out air nozzle is arranged in the sleeping mat main body.

9. The outdoor sleeping mat according to claim 8, wherein the pull-out air nozzle is arranged at the bottom of the sleeping mat main body.

10. A sleeping mat set, comprising an accommodating bag and the outdoor sleeping mat according to claim 1, wherein the outdoor sleeping mat can be placed in the accommodating bag after the cavity of the outdoor sleeping mat is deflated.

* * * * *